US005494736A

United States Patent [19]

Willey et al.

[11] Patent Number: 5,494,736

[45] Date of Patent: Feb. 27, 1996

[54] HIGH ELONGATION THERMALLY BONDED CARDED NONWOVEN FABRICS

[75] Inventors: Jacqueline A. Willey, Mauldin; William L. Cox, Pickens, both of S.C.

[73] Assignee: Fiberweb North America, Inc., Simpsonville, S.C.

[21] Appl. No.: 177,698

[22] Filed: Jan. 4, 1994

Related U.S. Application Data

[63] Continuation of Ser. No. 11,400, Jan. 29, 1993, abandoned.

[51] Int. Cl.[6] ..... D04H 1/42; D04H 1/54; D04H 1/72

[52] U.S. Cl. ..... 428/288; 156/308.4; 428/296; 602/45

[58] Field of Search ..... 156/308.4; 428/288, 428/296; 602/45

[56] References Cited

U.S. PATENT DOCUMENTS 4,668,563 5/1987 Buese et al. ..... 428/23

4,856,502 8/1989 Ersfeld et al. ..... 428/253

5,114,631 5/1992 Nyssen ..... 264/6

FOREIGN PATENT DOCUMENTS

445536A2 9/1991 European Pat. Off. .

*Primary Examiner*—James C. Cannon

*Attorney, Agent, or Firm*—Bell, Seltzer, Park & Gibson

[57] ABSTRACT

The invention provides high elongation thermally bonded nonwoven fabrics which exhibit elongation of at least about 130% in the cross-machine direction. The fabrics of the invention include a nonwoven a web of polyolefin staple fibers having an elongation of at least 400 percent, and a multiplicity of discrete thermal bonds throughout the web to provide a bond area of from 8 to 25 percent of the area of the fabric.

13 Claims, 1 Drawing Sheet

HIGH ELONGATION THERMALLY BONDED CARDED NONWOVEN FABRICS

This application is a continuation of application Ser. No. 08/011,400, filed Jan. 29, 1993, now abandoned.

FIELD OF THE INVENTION

The invention relates to nonwoven fabrics and to processes for producing the nonwoven fabrics. More specifically, the invention relates to high elongation thermally bonded carded nonwoven fabrics having desirable strength, conformability, and extensibility properties, suitable for use in absorbent products, such as disposable diapers, adult incontinence pads and sanitary napkins, and the like.

BACKGROUND OF THE INVENTION

Nonwoven fabrics are desirable for use in a variety of products such as bandaging materials, garments, diapers, supportive clothing and personal hygiene products. Nonwoven fabrics that have high elongation are particularly desirable for various uses, including use as a component of a personal care fabric, because of their ability to conform to irregular shapes and to allow more freedom of body movements than do fabrics with limited extensibility.

One such nonwoven fabric known in the art is carded thermobonded nonwoven fabrics. Carded thermobonded fabrics are produced by forming a carded web of staple fibers and thermally bonding the web so that the staple fibers soften and fuse together to form a unitary structure. Carded thermobonded webs, however, typically exhibit limited elongation. To achieve increased elongation, prior techniques have added an elastomeric material to the product. However, elastomeric materials typically have a poor hand or feel, and thus elastic nonwovens can suffer from poor fabric aesthetics. Further, processing elastomeric can be difficult, resulting in breakage or elastic failure of the fibers or filaments during extrusion and drawing. In addition, elastomeric materials are costly.

Therefore, to produce products having high elongation without using elastomeric materials, alternative converting methods typically must be used. Most of these converting methods, however, involve multiple processes, and thus result in reduced volume and production efficiencies as compared with other converting processes. Accordingly, it would be desirable to efficiently produce nonwoven fabrics having good elongation and tensile properties using fewer converting steps and operation facilities.

SUMMARY OF THE INVENTION

The present invention provides a process for producing a high elongation fabric without requiring the use of expensive and difficult to process elastomeric materials and bypassing the complicated multiple step converting procedures typically used. In the process of the present invention, high elongation polyolefin staple fibers are processed using nonwoven carding techniques. Preferably, the staple fibers have an elongation of about 400 to about 600% prior to processing.

During web formation, the high elongation staple fibers are carded and oriented substantially in the cross machine direction of the web so that the web exhibits a tensile strength ratio in the machine direction as compared to the cross machine direction of about 2:1 to about 4:1. It is believed that using high elongation fibers oriented in the cross machine direction as described above provides nonwoven fabrics having a high degree of cross machine direction elongation, yet also having good tensile strengths in the machine direction.

The carded nonwoven web is then thermally bonded to provide a multiplicity of discrete thermal bonds throughout the web. Preferably the bond area of the fabric is from about 8 to 25 percent of the area of the fabric. It is believed that this also contributes to the high elongation properties of the fabric. That is, the fabric is bonded sufficiently to provide good strength properties but is not overly bonded so as to avoid undesirable aesthetics, such as stiffness, and the like, or reduction in elongation properties. The thermal bonds act to bond the high elongation fibers of the web to form a strong fabric having an elongation in the cross machine direction of at least 130 percent. In addition, the resultant nonwoven fabrics have a basis weight of from 20 to 30 grams per square yard, a machine direction tensile strength of at least 1400 g/inch and a cross machine direction tensile strength of at least 400 g/inch.

Use of carded thermal bond technology to achieve high elongation and high tensile strength properties without sacrifice of aesthetics provides a significant advantage in the production of nonwoven fabrics, particularly for fabrics incorporated as a component of another product. Because the nonwoven fabrics of the invention exhibit good cross machine direction elongation properties, they can be used as a component of nonwoven products without requiring multiple processing and/or converting steps. Further, the nonwoven fabrics of the invention can be processed on existing fabric processing and converting equipment without requiring special devices. Thus the nonwoven fabrics of the invention can be manufactured more conveniently and efficiently and can be processed thereafter with less restrictions than prior fabrics.

BRIEF DESCRIPTION OF THE DRAWINGS

In the drawings which form a portion of the original disclosure of the invention.

DETAILED DESCRIPTION OF THE INVENTION

In the following detailed description of the invention, specific preferred embodiments of the invention are described to enable a full and complete understanding of the invention. It will be recognized that it is not intended to limit the invention to the particular preferred embodiments described, and although specific terms are employed in describing the invention, such terms are used in the descriptive sense for the purpose of illustration and not for the purpose of limitation. It will be apparent that the invention is susceptible to variation and changes within the spirit of the teachings herein.

Figure 1:
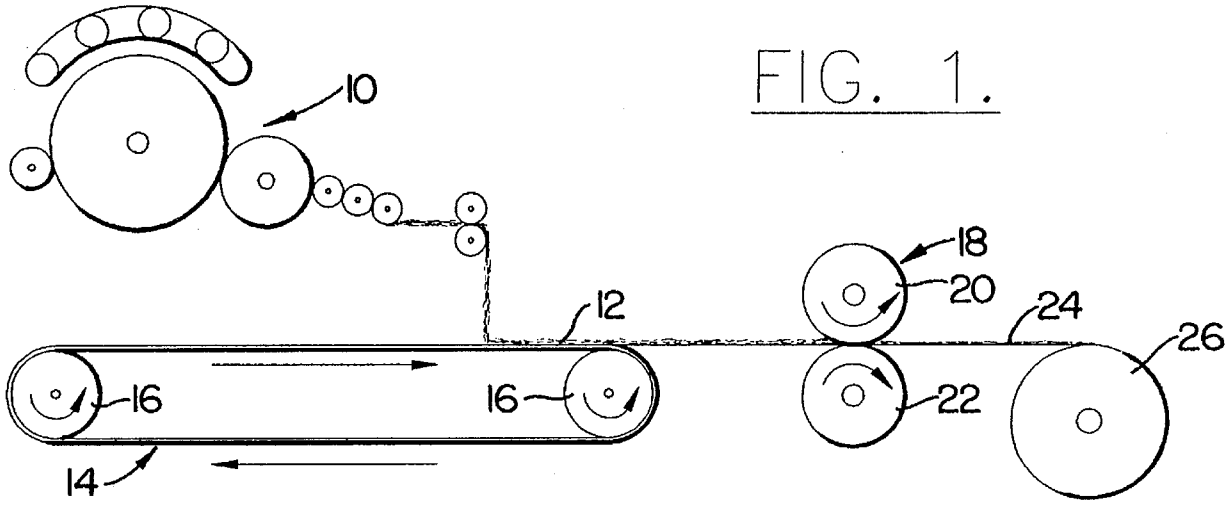
FIG. 1 is a schematic illustration of one preferred process for producing a fabric in accordance with the invention.

FIG. 1 schematically illustrates a suitable process and apparatus for forming the composite nonwoven webs of the invention. A carding machine, designated generally at 10, forms a carded web 12 onto forming screen 14. Web 12 is then moved by forming screen 14 in the longitudinal direction by rolls 16.

As known in the art, carding is a mechanical process whereby clumps of staple fibers are separated into individual fibers and simultaneously made into a coherent web. Carding is typically carried out on a machine which utilizes opposed moving beds or surfaces of fine, angled closely spaced teeth or wires or their equivalent to pull and tease the clumps apart. The teeth of the two opposing surfaces typically are inclined in opposite directions and move at different speeds relative to each other.

In traditional textile carding techniques, the two beds of teeth separate the clumps into individual fibers which are aligned predominantly and generally in the machine direction. The individualized fibers engage each other randomly, and with the help of their crimp, form a coherent web at and below the surface of the teeth on the main cylinder. The fibers are then directed to a moving screen via means for stripping or "doffing" the web off the cylinder.

In nonwoven carding processes, it is often desirable that the fibers be somewhat less oriented and that they be more randomly laid down to form the carded web. As will be appreciated by the skilled artisan, the carding machine can include additional rolls, referred to as "scrambler rolls," and a mechanism connected therewith for adjusting the speed of the scrambler rolls relative to one another. Accordingly, the carding machine can be adjusted so that the scrambler rolls provide varying degrees of scramble ratios as compared to traditional textile carding apparatus.

The degree of scramble or transverse orientation of the fibers can be expressed as a ratio of tensile strength of the fabric in the machine direction (MD) as compared to the tensile strength in the cross machine direction (CD) of the carded web (expressed as MD/CD grams/inch). Typically, carded nonwoven webs exhibit a tensile strength ratio of about 5/1 to about 7/1. In the present invention, the carded web is formed so that the fibers are highly oriented in the cross machine direction, i.e., so that the number of fibers laid down transverse to the cross machine direction is controlled. Advantageously, the carded webs of the present invention have a tensile strength ratio (machine direction/cross machine direction) of about 2/1 to about 4/1, and preferably about 2.5/1 to about 3.5/1. Thus a higher degree of the fibers are oriented substantially in the cross machine direction than in typical carded nonwoven fabrics to provide increased elongation in the cross machine direction.

In addition, advantageously the draft used during processing is less than about 50% total. Using a lower draft helps in the transfer of the web from line to line and minimizes the loss of orientation in the cross machine direction.

The carded web 12 is formed using polyolefin staple fibers which have a high degree of elongation prior to processing. Typically, fibers used in nonwoven carded web production have a pre-processing elongation of about 200 to 300%. In the present invention, the fibers used in the production of the high elongation fabrics have an elongation prior to processing of from about 400% to about 600%. In addition, the fibers used in accordance with the present invention have a sufficient tensile strength so as to provide good tensile properties of the final product. Accordingly, advantageously the fibers used have a tenacity of from about 1.5 to about 3 g/den, and preferably a tenacity of about 1.8 to 2 g/den. Furthermore, the fibers have a denier of about 1.8 to about 3. High elongation fibers are known in the art and are commercially available, for example, from Hercules, Inc. and Danaklon A/S. One exemplary example of fibers useful in the present invention is described in published European Patent Application 445,536-A2, the disclosure of which is incorporated herein in its entirety.

After the carded nonwoven web 12 is deposited by carding apparatus 10 onto forming screen 14, the nonwoven web is moved by forming screen 14 in the longitudinal direction to a thermal treatment station 18, where carded nonwoven web 12 is thermally point bonded. The thermal treatment station is shown in FIG. 1 as heated calender rolls 20 and 22. The operating temperature of heated rolls 20 and 22 should be adjusted to a surface temperature such that the polymer of the polyolefin fibers present in the nonwoven web 12 soften and bind the fibrous nonwoven web to thereby form a nonwoven fabric 24. Bonding conditions, including temperature and pressure, vary according to the particular polymer used and operating conditions and are known in the art for differing polymers.

Although a preferred method of bonding has been illustrated in FIG. 1, the heated calender rolls 20 and 22 can, in other embodiments of the invention, be replaced by other thermal activation zones. For example, the thermal treatment station may be in the form of a through-air bonding oven or in the form of a microwave or other RF treatment zones, so long as the percentage area of the exposed areas of the web is controlled, for example, by using a patterned screen to thereby provide specific bonding sites. Other heating stations such as ultrasonic welding stations can also be advantageously used in the invention. Such conventional heating stations are known to those skilled in the art and are capable of effecting substantial thermal fusion of the nonwoven webs via discontinuous thermal bonds distributed substantially throughout the nonwoven fabric 24.

Figure 2:
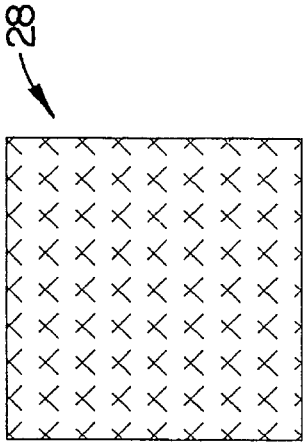
FIG. 2 is a fragmentary plan view of a nonwoven fabric of the invention illustrating patterned discontinuous bond lines.

The pattern of the embossing calendar may be any of those known in the art, including spot bonding patterns, helical bonding patterns, and the like. The term spot bonding is used herein to be inclusive of continuous or discontinuous pattern bonding, uniform or random point bonding, or a combination thereof, all as are well known in the art. FIG. 2 is a fragmentary plan view of a fabric of the invention, designated generally at 28, illustrating one embodiment of a bonding pattern useful for bonding the nonwoven fabrics of the present invention. Specifically, FIG. 2 illustrates a nonwoven fabric thermally bonded using patterned discontinuous bond lines.

The amount of bond area is also believed to be a factor in providing the high cross machine direction elongation properties of the nonwoven fabrics. As the percent bond area decreases, as the skilled artisan will appreciate, the nonwoven web is typically insufficiently bonded together, and can exhibit pilling, peeling, and the like. As the percentage bond area increases, desirable aesthetics of the fabrics decrease, i.e., the web may become stiff or boardy, and can exhibit decreased drapability. In addition, as bond area increases, the fabric is less able to expand without stressing or breaking bond sites, and accordingly desirable cross machine direction elongation is decreased. Preferably, to provide optimal elongation, strength and aesthetics, the bond area of the nonwoven fabric is from about 8 to 25% of the area of the fabric, and more preferably about 15 to 20%.

The thermally-bonded nonwoven fabric 24 is then removed from the nip of the heated rolls 20 and 22 and wound by conventional means onto roll 26. The nonwoven fabric 24 can be stored on roll 26 or immediately passed to end use manufacturing processes, for example for use in bandages, diapers, disposable undergarments, personal hygiene products and the like.

Although not wishing to be bound by any explanation of the invention, it is believed that the use of the high elongation polyolefin fibers of the present invention with a high degree of orientation in the cross machine direction provides a fabric that exhibits superior extensibility in the cross machine direction. Specifically, the carded nonwoven webs of the invention exhibit elongation in the cross machine direction of at least about 130%, and preferably about 160%. In contrast, typical nonwoven carded thermobonded fabrics exhibit cross machine direction elongation of less than about 100%. Because the nonwoven fabrics of the invention exhibit good cross machine direction elongation properties, they can be used as a component of nonwoven products without requiring multiple processing and/or converting steps. Further, the nonwoven fabrics of the invention can be processed on existing fabric processing and converting equipment without requiring special devices. Thus the nonwoven fabrics of the invention can be manufactured in a more convenient and straightforward manner and can be processed thereafter with less restrictions than prior fabrics.

The nonwoven fabrics thus formed also have a basis weight of from 20 to 30 grams per square yard, a machine direction tensile strength of about 1400 to 2700 grams/inch, and a cross machine direction tensile strength of about 400 to 800 grams/inch.

The method illustrated in FIG. 1 is susceptible to numerous preferred variations. For example, although the schematic illustration of FIG. 1 shows carded webs being formed directly during the in-line process, it will be apparent that the carded webs can be preformed and supplied as rolls of preformed webs.

The nonwoven fabrics of the present invention may be used as a high elongation nonwoven component in a disposable absorbent personal care product, such as a topsheet layer, a backsheet layer, or both, in a diaper, an incontinence pad, a sanitary napkin, and the like; as a wipe; as a surgical material, such as a sterile wrap or surgical gown; and the like. For example, as with the construction of diapers, the nonwoven webs of the invention may be used as a topsheet layer, backsheet layer, or both, in disposable personal care products. Further, the nonwoven webs of the invention may be used in these products in combination with other webs, such as a liquid impermeable layer and an absorbent body.

For example, the high elongation nonwoven web according to the invention can advantageously be used as a coverstock layer in a disposable personal care product, such as a disposable diaper. In one aspect of this embodiment of the invention, the high elongation nonwoven web of the invention is used as a topsheet layer in a diaper. The topsheet layer advantageously permits liquid to rapidly flow through it into the absorbent core (referred to in the art as "rapid strike through") but does not facilitate re-transmission of liquid back from the absorbent core to the body side of the topsheet (referred to in the art as "rewet resistance"). To achieve a desirable balance of strike through and rewet resistance, the nonwoven webs of the invention can be treated to impart hydrophilic characteristics thereto. For example, the nonwoven web of the invention or the surface thereof can be treated with a surfactant as are well known in the art, such as Triton X-100 or the like.

The nonwoven web produced as described above is then combined with an absorbent body, for example, a preformed web substantially made of cotton-like woody pulp, located in facing relationship with the inner surface of a substantially liquid impermeable backsheet layer. Wood pulp may be included in the absorbent body, preferably by incorporating the wood fiber from a hammer milled water laid web or from an air laid web which may contain staple textile fibers, such as cotton, reconstituted cellulose fibers, e.g., rayon and cellulose acetate, polyolefins, polyamides, polyesters, and acrylics. The absorbent core may also include an effective amount of an inorganic or organic high-absorbency (e.g., superabsorbency) material as known in the art to enhance the absorptive capability of the absorbent body.

The nonwoven web may be combined with the absorbent body and the substantially liquid impermeable backsheet layer in any of the ways known in the art, such as gluing with lines of hot-melt adhesive, seaming with ultrasonic welding, and the like.

In another aspect of this embodiment, an high elongation nonwoven web according to the invention is used as a backsheet layer of a diaper. The high elongation nonwoven web is given barrier properties by any of the ways known in the art. For example, barrier properties can be obtained by laminating a polyolefin film, for example a polyethylene or a polypropylene film, to the high elongation nonwoven web. The polyolefin film may be laminated with the high elongation nonwoven web of the invention by either point or continuous bonding of the web and the film via either smooth or patterned calender rolls. The lamination may also be achieved by the use of an appropriate bonding agent.

The high elongation nonwoven laminate is then combined with an absorbent body, such as a preformed web of wood pulp, located in a facing relationship with the inner surface of a substantially liquid permeable topsheet layer to produce a diaper. The high elongation nonwoven web and the absorbent body may be combined in any of the ways known in the art.

Diapers can also be produced wherein both the topsheet and backsheet layers of a diaper are comprised of a high elongation nonwoven web according to the invention.

The following examples are provided to illustrate the fabrics of the invention and processes for making them but is not to be construed as a limitation on the invention.

Example 1

Samples of a carded thermobonded nonwoven web were prepared according to the present invention. The samples were prepared using high elongation polypropylene stable fibers available from Hercules, Inc. (Type 190 variation), having a preprocessing elongation of about 400%. Other fiber properties include: 2.5 dpf; tenacity of 1.6 g/in.

The fibers were processed using a nonwoven carding apparatus adjusted so that a substantial amount of the fibers were oriented in the cross machine direction. Each carded nonwoven web sample was passed through a calender fitted with 17% bonding rolls at a temperature of about 135°–138° C.

The samples were tested for percent elongation and tensile strength in the cross machine direction using ASTM test methods. Tensile strength was tested using ASTM Standard Test Method D1682 (Breaking Load and Elongation of Textile Fabrics—one inch cut strip method). The results reflect the average of five tests, and are set forth below in Table 1.

TABLE 1

| Sample No. | Basis Weight ($g/y^2$) | % Elongation in the Cross Machine Direction | Tensile, Cross Machine Direction (g/in) |
|---|---|---|---|
| 1 | 25.5 | 138 | 680 |
| 2 | 23.3/22.6 | 148 | 693 |
| 3 | 23.3/24.0 | 132 | 383 |
| 4 | 21.2 | 148 | 497 |

Example 2

Twenty samples of a carded thermobonded nonwoven web were prepared according to the process of the present invention. High elongation polypropylene fibers having a pre-processing elongation of about 400% were obtained from Hercules, Inc. under the trade name T191. The fibers were processed using a nonwoven carding apparatus adjusted so that a substantial amount of the fibers were oriented in the cross machine direction, and so that the nonwoven fabrics had an average MD/CD tensile strength ratio of approximately 3.5:1. In addition, drafting was less than 50%.

Each carded nonwoven web sample was passed through a calender fitted with 17% bonding rolls at a rate of about 140 meters per minute. The roll temperatures were about 170° C.

The samples were tested for a variety of fabric properties, and the average of the results of the tests are set forth below in Table 2. All testing was done using ASTM test methods. Tensile strength in the machine and cross machine directions of each sample was tested using ASTM Standard Test Method D1682 (Breaking Load and Elongation of Textile Fabrics—one inch cut strip method). The tensile strength in both the machine direction and the cross machine direction was evaluated.

TABLE 2

| | Average |
|---|---|
| BASIS WEIGHT (g/y$^2$) | 25.6 |
| CROSS MACHINE DIRECTION TENSILE (g/in) | 657 |
| MACHINE DIRECTION TENSILE (g/in) | 2710 |
| STRETCH (%) | |
| CROSS DIRECTION | 178 |
| MACHINE DIRECTION | 115 |
| LOFT | 13.9 |
| RUNOFF (%) | |
| STRIKETHROUGH (sec) | 257 |
| FUZZ (mg) | 0 |
| SOFTNESS (psu) | 2.18 |

That which is claimed is:

1. A high elongation thermally bonded nonwoven fabric comprising a web of polyolefin staple fibers, said polyolefin fibers having an elongation of at least 400 percent, and a multiplicity of discrete thermal bonds throughout the web, said thermal bonds having a bond area of from 8 to 25 percent of the area of the fabric and bonding the fibers of the web to form a strong fabric having an elongation in the cross machine direction of at least 130 percent.

2. A nonwoven fabric according to claim 1, wherein said web comprises a carded web formed with a processing draft of less than 50% total.

3. A nonwoven fabric according to claim 1, having a basis weight of from 20 to 30 grams per square yard, a machine direction tensile strength of at least about 1400 grams/inch and a cross machine direction tensile strength of at least about 400 grams/inch.

4. A nonwoven fabric according to claim 1 having a tensile strength ratio in the machine direction as compared to the cross machine direction of the fabric of about 2/1 to about 4/1 grams/inch.

5. A nonwoven fabric according to claim 1 having a tensile strength ratio in the machine direction as compared to the cross machine direction of the fabric of about 2.5/1 to about 3.5/1 grams/inch.

6. A high elongation thermally bonded nonwoven fabric comprising a web of polypropylene staple fibers, said fibers having an elongation of at least 400 percent, and a multiplicity of discrete thermal bonds throughout the web, said thermal bonds having a bond area of from 8 to 25 percent of the area of the fabric and bonding the lower melting sheath components of the fibers to form a strong fabric having an elongation in the cross machine direction of at least 130 percent, a basis weight of from 20 to 30 grams per square yard, a machine direction tensile strength of about 1400 to 2700 grams/inch and a cross machine direction tensile strength of about 400 to 800 grams/inch.

7. A process for producing a high elongation thermally bonded nonwoven fabric comprising:

forming a nonwoven web of polyolefin staple fibers, said polyolefin fibers having an elongation of at least 400 percent; and forming a multiplicity of discrete thermal bonds throughout the web, said thermal bonds having a bond area of from 8 to 25 percent of the area of the fabric, to form a strong fabric having an elongation in the cross machine direction of at least 130 percent.

8. A process according to claim 7 wherein the step of forming said nonwoven web comprises processing the polyolefin staple fibers through a carding machine and forming a carded web.

9. A process according to claim 8 wherein the processing of the fibers through a carding machine employs a processing draft of less than 50% total.

10. A process according to claim 7 wherein the step of forming a nonwoven web comprises orienting the fibers so that the machine direction tensile strength as compared to the cross machine direction tensile strength of the fabric is about 2/1 to about 4/1 grams/inch.

11. A process according to claim 7 wherein the step of forming a nonwoven web comprises orienting the fibers so that the machine direction tensile strength as compared to the cross machine direction tensile strength of the fabric is about 2.5/1 to about 3.5/1 grams/inch.

12. A process according to claim 7 wherein the step of forming a nonwoven web comprises forming a nonwoven fabric having a basis weight of from 20 to 30 grams per square yard.

13. A process for producing a high elongation thermally bonded nonwoven fabric comprising:

forming a nonwoven web of polypropylene staple fibers, said fibers having an elongation of at least 400 percent; and thermally bonding the fibers via a multiplicity of discrete thermal bonds throughout the web, said thermal bonds having a bond area of from 8 to 25 percent of the area of the fabric, to thereby form a strong fabric having an elongation in the cross machine direction of at least 130 percent, a basis weight of from 20 to 30 grams per square yard, a machine direction tensile strength of about 1800 to 2700 grams/inch and a cross machine direction tensile strength of about 400 to 800 grams/inch.

* * * * *